United States Patent [19]

Bouchet

[11] Patent Number: 4,493,561

[45] Date of Patent: Jan. 15, 1985

[54] REVERSIBLE WRIST WATCH

[75] Inventor: Jean Bouchet, Troinex, Switzerland

[73] Assignee: Bouchet-Lassale S.A., Geneva, Switzerland

[21] Appl. No.: 486,305

[22] Filed: Apr. 19, 1983

[30] Foreign Application Priority Data

May 11, 1982 [CH] Switzerland ..... 2923/82

[51] Int. Cl.[3] ..... A44C 5/00; G04B 37/00

[52] U.S. Cl. ..... 368/281; 368/276; 368/282; 368/223

[58] Field of Search ..... 368/276–285, 368/223

[56] References Cited

U.S. PATENT DOCUMENTS

| | | | |
|---|---|---|---|
| 2,236,650 | 4/1941 | Pujol | 368/283 |
| 3,293,846 | 12/1966 | Pauli | 368/282 |

FOREIGN PATENT DOCUMENTS

| | | | |
|---|---|---|---|
| 712868 | 10/1931 | France . | |
| 1161758 | 9/1958 | France . | |
| 2007577 | 1/1970 | France . | |
| 2447692 | 8/1980 | France | 368/276 |
| 138929 | 6/1930 | Switzerland . | |

*Primary Examiner*—Bernard Roskoski

*Attorney, Agent, or Firm*—Young & Thompson

[57] ABSTRACT

The invention relates to a wrist watch comprising a watch case (1) made of two parts (7, 8) fixed the one to the other and each forming one of the faces of the reversible watch. This case (1) is rotatively mounted along its six o'clock-noon axis on two bars (2, 3) each receiving one end of the bracelet (4). The case (1) comprises two lateral covers (5, 6) hinged at one of their ends on the case (1) covering in service position the lateral edges of the watch case.

10 Claims, 10 Drawing Figures

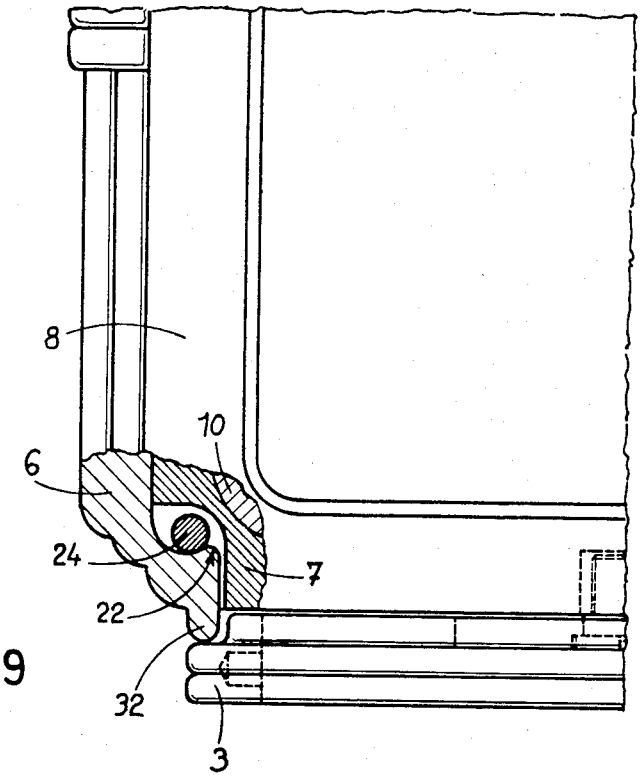
FIG. 9
FIG. 10
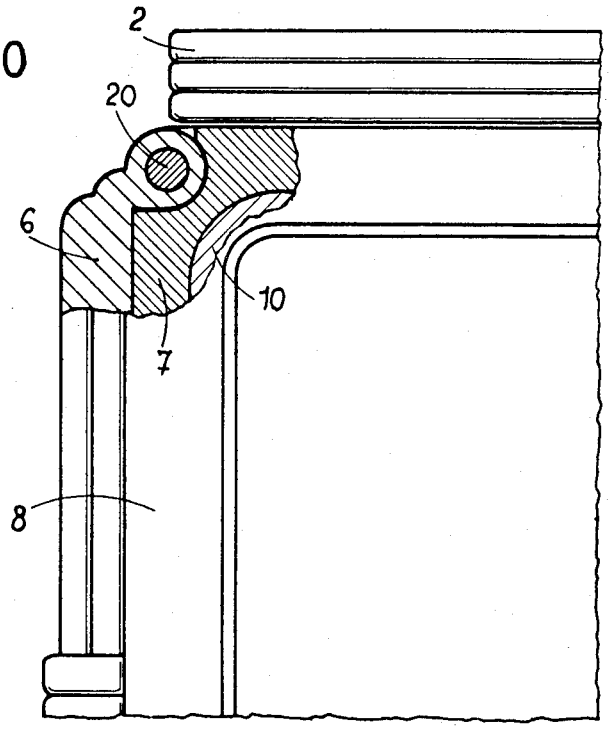

REVERSIBLE WRIST WATCH

BACKGROUND OF THE INVENTION

The present invention has for its object a wrist watch of the reversible type, i.e. the case of which, enclosing the watch movement, can be reversed by being inverted, so that either side of the watch may be selectively turned outward.

The "reverso" watch of Jaeger Le Coultre is of this type, but the watch case being located in a recess of a base plate, and hinged on said plate to permit its inversion, the thickness of the watch is necessarily important.

The present invention has for its object a wrist watch of the reversible type having a low thickness.

BRIEF DESCRIPTION OF THE DRAWINGS

The attached drawings show schematically and by way of example one embodiment of the wrist watch according to the invention.

FIG. 9 is a detail at greater scale of part F of the watch case shown at FIG. 3.

FIG. 10 is a detail at greater scale of part I of the watch case shown in FIG. 3.

DETAILED DESCRIPTION

Figure 1:
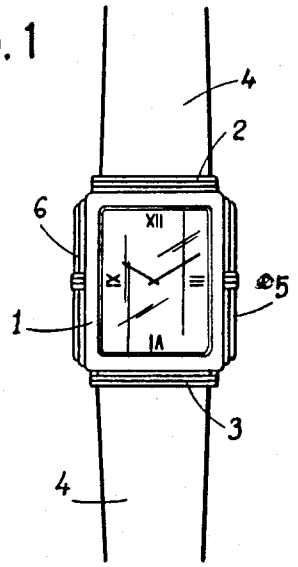
FIG. 1 is a plan view of the wrist watch in service position.
Figure 2:
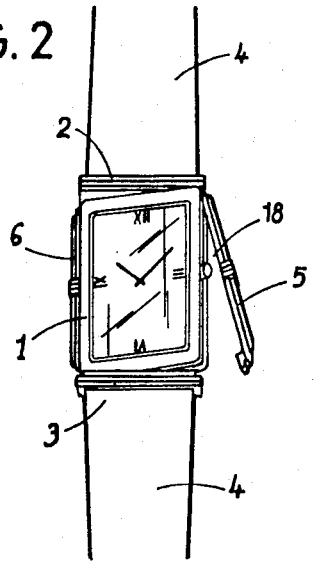
FIG. 2 is a plan view of the wrist watch, one of the lateral covers being partially open.
Figure 3:
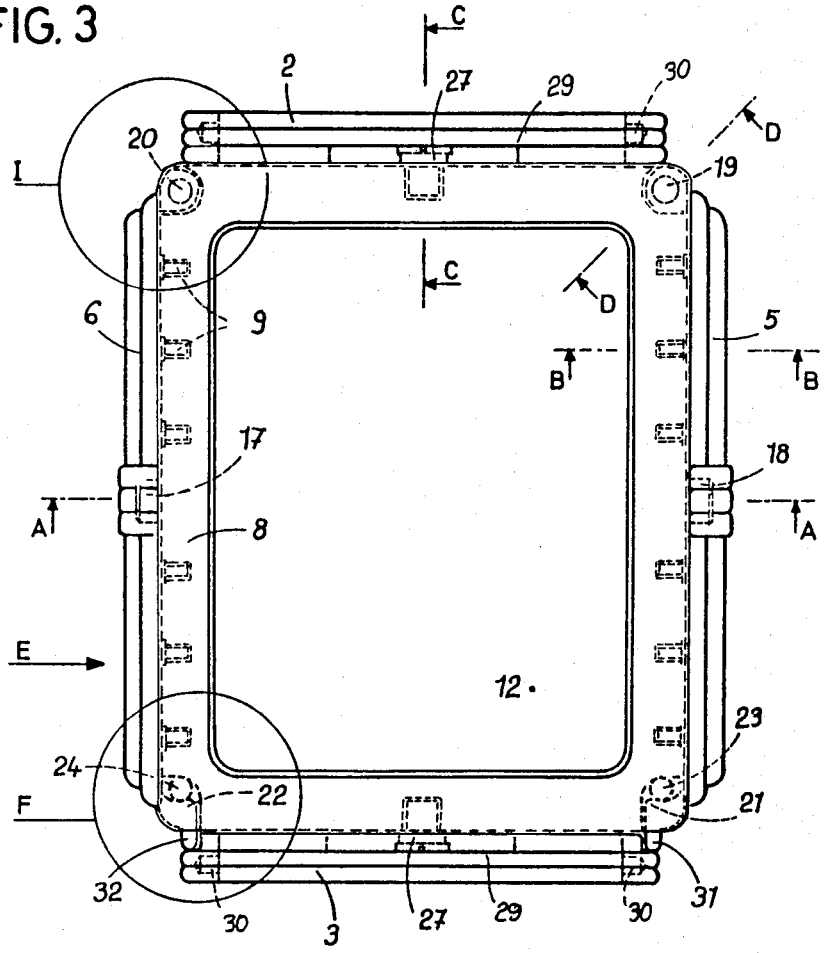
FIG. 3 is a plan view at greater scale of the case of the wrist watch according to the invention.
Figure 4:
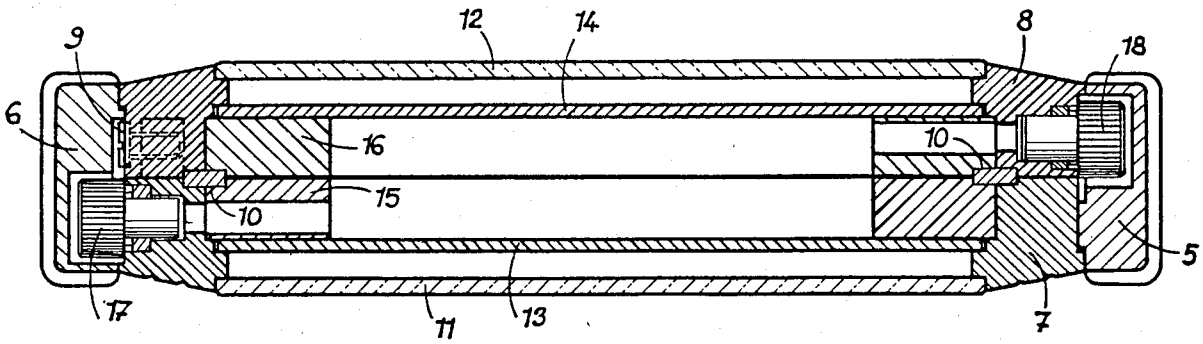
FIG. 4 is a cross-section along line A—A of FIG. 3.
Figure 5:
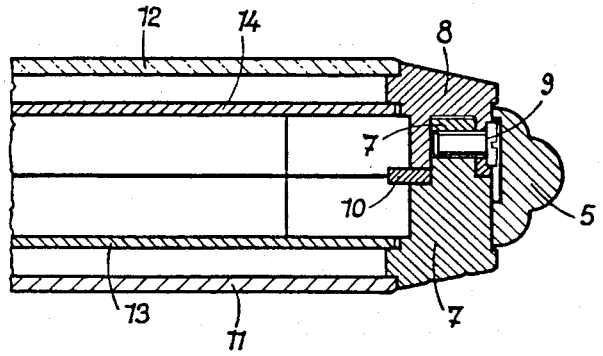
FIG. 5 is a cross-section along line B—B of FIG. 3.

The illustrated wrist watch comprises a watch case 1 pivotally mounted on two bars 2, 3 located on either side of the case and intended to be fixed to the ends of a strap 4. This watch case 1 comprises further lateral covers 5, 6 pivotally mounted and forming in service position the lateral edges of the watch case.

In the embodiment shown, the watch case 1 is formed of two parts 7, 8 encased the one in the other and fastened together by means of screws 9. A seal 10 provides a perfect tightness between the two parts 7, 8 of the watch case. In the example shown, each part 7, 8 of the watch case comprises a crystal 11 respectively 12, and is adapted to receive a watch movement (not shown) the dial of which 13 respectively 14 is pressed between a casing ring 15, respectively 16 and the part 7, 8 of the watch case.

Each movement can be set to the desired time, respectively wound up, if it is a mechanical movement, by means of winding crowns 17, 18 the stem of which passes through parts 7, 8 and the casing rings 15, 16 respectively.

The lateral covers 5, 6 are hinged at one of their ends on a pin 19, 20 driven in holes of the parts 7, 8 of the case 1. The free end of the covers 5, 6 is provided with a notch 21, 22 forming with a pin 23, respectively 24, driven in holes of the parts 7, 8, a locking device of the covers in closed service position, in which they hide the screws 9 and the winding crowns 17, 18.

This watch case 1 made of two parts 7, 8 and of the covers 5, 6 is pivotally mounted on the bars 2, 3 which are intended for fixing the ends of a strap 4.

Figure 6:
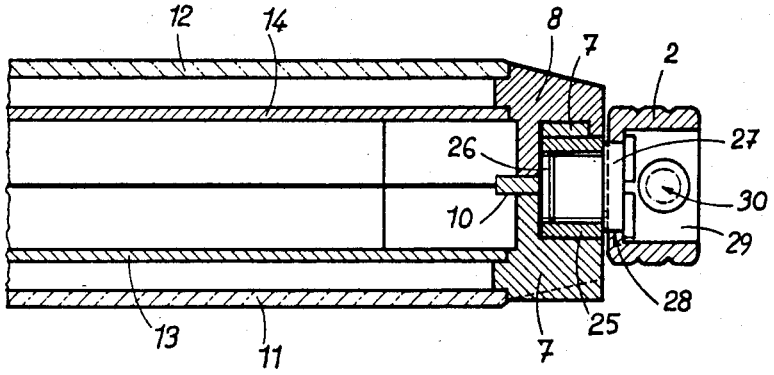
FIG. 6 is a cross-section along line C—C of FIG. 3.
Figure 7:
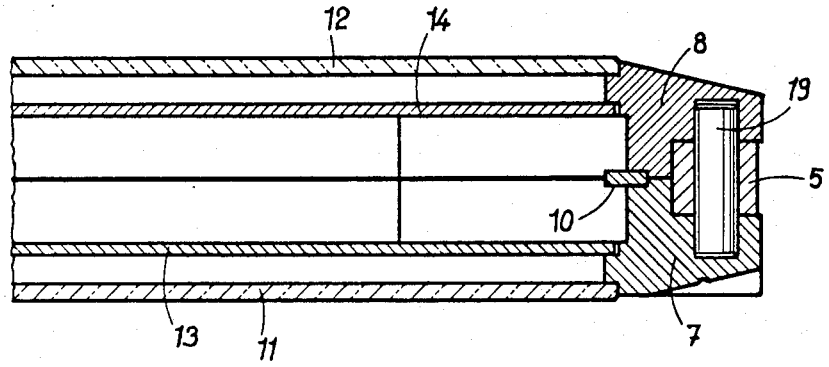
FIG. 7 is a cross-section along line D—D of FIG. 3.
Figure 8:
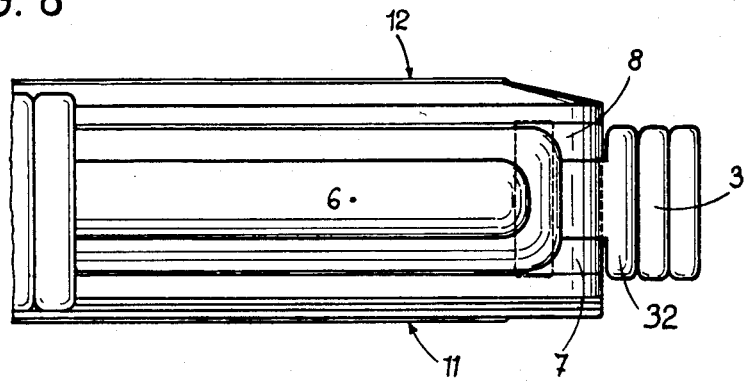
FIG. 8 is a partial view seen from E (FIG. 3) of the watch case.

In FIG. 6 it can be seen that in the ends of the case facing the bars 2, 3, sleeves 25 are driven in a passage 26 provided in the parts 7, 8. These sleeves 25 are coaxial with the six o'clock-noon axis of the watch case 1.

These sleeves 25 have a threaded internal surface in which are screwed step screws 27 the head of which revolves freely inside a hole 28 of corresponding diameter provided in the bars 2, 3.

The bars 2, 3 have a hollow portion 29 intended to receive the end of a watch strap and blind holes 30 at the ends of said hollow portion and opening in it intended to receive the resilient lugs for fixing the strap.

The watch case is thus pivotally mounted on the bars 2, 3 and connected through said bars to the strap. To fix the service position or positions of the watch case with respect to the bars, one can have a pin cooperating with a notch one of which is provided in the face of the bar turned towards the case and the other in the face of the case facing said bar.

It is to be noted that the ends of the covers comprise locking notches 21, 22 having operating beaks 31, 32 which enable the users to open the cover when the case is pivoted out of its service position, i.e. out of the plane containing the bars 2, 3. In the service position of the watch case, the operating beaks 31, 32 are located in recesses of the bar 3, being thus inaccessible for the user. These covers can thus not be opened in the service position of the watch case.

In the embodiment described, the watch case 1 contains two movements the display of which appears on the one respectively on the other face of the case.

The decoration of the two faces of the watch case can be different providing for an evening watch on one side and for a sport watch on the other side for example.

It is evident that in a variant, the watch case could have only one watch movement the display of which would be visible from one side of the case only. The other side or bottom of the case can in such a realization be engraved, colored, or be provided with precious or semi-precious stones on its outside face. The user has then a wrist watch when the display is turned towards the outside of the wrist and has a bracelet without watch when this display is turned towards the wrist.

Finally, only one and the same watch movement can drive two displays in opposite directions the one from the other. In this way one obtains a double face watch having only one motor.

It is to be noted that the presence of the lateral covers 5, 6 enables hiding, in service position, all the screws fixing the two parts of the watch case as well as the winding and/or time setting crowns, and this provides a very elegant watch.

This new reversible wrist watch has the following major advantages:

1. Its manufacture is simple and robust.
2. The case is made out of two parts which are interlocked and screwed comprising each a face which can be visible and which is able to have different displays and/or decorations.
3. The lateral covers hide the screws and the winding crowns.
4. The case can contain two movements.
5. The passage of the watch from one position to the other is obtained by a simple pivoting of the case on the bars connected to the strap.

6. The thickness of a reversible, two displays watch can through this realization be lowered and be equal to or near the width of the extra-thin watches.

I claim:

1. Reversible wrist watch, comprising a watch case made of two parts fixed one to the other and constituting each one of the faces of the reversible watch; means pivotally mounting the case along its six o'clock-noon axis on two bars perpendicular to said axis each of which bars receives one end of a watch strap; the case comprising two lateral covers hinged each at one of their ends to the case, said covers covering in service position the lateral edges of the watch case.

2. Watch according to claim 1, in which at least one of said parts forming the case has a crystal and houses a watch movement the display of which is visible through said crystal, and a winding and/or time setting crown of this movement which is, in service position, hidden under one of said lateral covers of the case.

3. Watch according to claim 2, in which the other said part of the case comprises also a crystal and houses a second watch movement the display of which is visible through said second crystal, and a winding and/or time setting crown of said second movement which is hidden, in service position, under said other lateral cover of the case.

4. Watch according to claim 2, in which said other part forming the case comprises a second crystal through which appears the dial of a second display, and a single watch movement driving the two displays in opposite directions.

5. Watch according to claim 2, in which said other part forming the case comprises a visible face provided with a decoration.

6. Watch according to claim 1, and a locking device for the case in one of its service positions.

7. Watch according to claim 1, in which the other end of each lateral cover of the case is fixed to the case in service position through a locking device.

8. Watch according to claim 7, in which said locking devices of the covers comprise each a notch carried by the cover cooperating with a pin driven in the case, and a housing in said case to receive said other end of the cover.

9. Watch according to claim 7, in which at least one of the bars comprises a recess receiving an operating member of the lateral covers so that the access to this member is not possible in the service position of the case.

10. Watch according to claim 1, in which said bars comprise a housing receiving one end of a watch strap as well as fixing means of said watch strap end onto the bar.

* * * * *